US007229371B2

(12) United States Patent
Walsh

(10) Patent No.: US 7,229,371 B2
(45) Date of Patent: Jun. 12, 2007

(54) REMOVABLE FLETCHING FOR USE WITH ARCHERY ARROWS

(76) Inventor: Timothy C. Walsh, 6932 N. Tryon, Suite 7, Charlotte, NC (US) 28213

( * ) Notice: Subject to any disclaimer, the term of this patent is extended or adjusted under 35 U.S.C. 154(b) by 0 days.

(21) Appl. No.: 11/129,928

(22) Filed: May 16, 2005

(65) Prior Publication Data

US 2006/0258491 A1 Nov. 16, 2006

(51) Int. Cl.
*F42B 6/06* (2006.01)

(52) U.S. Cl. ..... 473/586

(58) Field of Classification Search ..... 473/578, 473/585, 586

See application file for complete search history.

(56) References Cited

U.S. PATENT DOCUMENTS

| | | | | |
|---|---|---|---|---|
| 2,782,036 A | | 2/1957 | Folberth, Jr. et al. | |
| 2,796,262 A | * | 6/1957 | Folberth, Jr. et al. | 473/586 |
| 2,830,818 A | * | 4/1958 | Otto | 473/586 |
| 2,976,043 A | | 3/1961 | Meyer | |
| 3,667,758 A | * | 6/1972 | Bengtsson | 473/586 |
| 3,815,916 A | | 6/1974 | Meszaros | |
| 4,204,307 A | | 5/1980 | Pfetzing | |
| 4,615,552 A | * | 10/1986 | Bengtson | 473/586 |
| 5,427,385 A | | 6/1995 | Conrad et al. | |
| 5,439,231 A | | 8/1995 | Roberts et al. | |
| 5,443,273 A | | 8/1995 | Lovorn | |
| 6,695,727 B1 | | 2/2004 | Kuhn | |

* cited by examiner

*Primary Examiner*—John A. Ricci
(74) *Attorney, Agent, or Firm*—Alston & Bird LLP

(57) ABSTRACT

A removable fletch, system utilizing the fletch, method of installing the fletch, and kit comprising the fletch and an installation jig. The fletch comprises a feather member extending from a mounting body in a first direction, and one or more locating pins and a locking pin extend from the mounting body in a second direction. The locating pins are insertable within holes disposed in the wall of a hollow-shafted archery arrow. The locating pins define angled engagement notches that contact the inner surface of the arrow body such that translation of the fletch with respect to the arrow body causes the fletch to be pulled tightly against the arrow body. The locking pin may be snapped into a corresponding hole within the arrow wall, thereby fixing the fletch to the arrow body. An installation drill jig may be used to drill holes within the arrow wall corresponding to the locating and locking pins of the fletch.

20 Claims, 8 Drawing Sheets

REMOVABLE FLETCHING FOR USE WITH ARCHERY ARROWS

BACKGROUND OF THE INVENTION

The invention relates to removable fletching for use with archery arrows. More particularly, the invention relates to fletching which may be easily removed and conveniently and securely replaced, such as when damaged or when another configuration of fletching is desired.

"Fletching" is typically defined as the feather-like appendages on an arrow or the arrangement of such appendages. By way of background, arrows for archery have what used to be feathers for fletching to help stabilize the arrow in flight. These are now mainly synthetic in composition and thin and light in construction. As such, they are easily damaged when an arrow goes astray or into the ground or underbrush. Fletching is typically glued on and must be replaced using special jigs, which requires the user to purchase substantial equipment or use an archery outfitter.

There have been various attempts to design replaceable fletching in the past. Some attempts, such as that described in U.S. Pat. No. 2,976,043, utilize arrows having slots defined through the arrow body, wherein flexible fletches may be removed or inserted through the slots. However, lengthy slots tend to unduly weaken the structure of an arrow body, particularly a hollow arrow body formed from aluminum or composite materials.

Other attempts to design replaceable fletching have focused on unitary interchangeable fletching units that may either be fitted around the arrow shaft, such as described in U.S. Pat. No. 4,204,307, or fixed to the rear end of the arrow shaft, such as described in U.S. Pat. No. 6,695,727. However, unitary fletching units tend to be somewhat bulky and weighty and may undesirably affect the aerodynamics and balance of the arrow. Further, the unitary fletching requires the replacement of all fletches even if only one is damaged.

It is desired to provide replaceable fletching that may be securely fastened to an archery arrow without the need for glue or expensive equipment. It is further desired to provide replaceable fletching that is low profile and lightweight so as not to undesirably affect the aerodynamics or balance of an arrow. It is still further desired to provide replaceable fletching that does not require slots to be cut into an arrow body. It is still further desired to provide replaceable fletching that does not require replacement of all fletching at one time.

BRIEF SUMMARY OF THE INVENTION

The invention is a removable fletch, system utilizing the fletch, method of installing the fletch, and kit comprising the fletch and an installation jig. The fletch comprises a feather member extending from a mounting body in a first direction, and one or more locating pins and a locking pin extend from the mounting body in a second direction. The locating pins are insertable within holes disposed in the wall of a hollow-shafted archery arrow. The locating pins define angled engagement surfaces that contact the inner surface of the arrow wall such that translation of the fletch with respect to the arrow body causes the fletch to be pulled tightly against the arrow. After the fletch is pulled tightly against the arrow body, the locking pin may be snapped into a corresponding hole within wall of the arrow body, thereby preventing movement of the fletch with respect to the arrow.

According to a first embodiment, a removable fletch is provided, having an elongate mounting body having a forward end and a rearward end, a feather member extending from the mounting body and having a forward and a rearward end corresponding to the respective ends of the mounting body, at least one locating pin extending from the mounting body opposite the feather member, said locating pin defining an engagement notch, and a locking pin extending from the mounting body opposite the feather member.

According to a second embodiment, a removable fletch system comprises the removable fletch of the first embodiment in addition to a hollow-shafted arrow having holes disposed therein, wherein the holes correspond to the location of the locating pin and the locking pin of the at least one fletch.

According to a third embodiment, a method of replacing the fletching of an arrow is provided comprising the steps of providing a fletch of the first embodiment, providing a hollow-shafted arrow having holes disposed therein, wherein at least one hole corresponds to the location of the locating pin and a hole corresponds to the locking pin of the at least one fletch, inserting the at least one locating pin of the fletch into the corresponding hole of the arrow, translating the fletch in the lengthwise direction of the arrow such that the engagement notch of the locating pin provides a friction fit with the inner surface of the arrow; and inserting that locking pin of the fletch into the corresponding hole of the arrow.

According to a fourth embodiment, a replacement kit is provided with the fletch of the first embodiment and a drill jig for use in drilling holes within the walls of a hollow-shafted arrow. Using the jig, a user can easily drill holes within the walls of the hollow-shafted arrow, such as an aluminum or carbon fiber arrow, so that the fletch may be easily installed upon a standard hollow-shafted archery arrow.

The invented fletch, system, method, and kit provide replaceable fletching that may be securely fastened to an archery arrow without the need for glue or expensive equipment. The mounting body of the fletch is low profile such that the size of the fletch does not undesirably affect the aerodynamics of the arrow. Further, the relatively small size of the fletch makes the fletch lightweight such that the fletch does not undesirably affect the balance of the arrow.

The locating pins of the fletch secure within holes that have a circular or simple geometric cross-section thereby avoiding the use of slots that could unduly weaken the structure of an arrow body, particularly a hollow arrow body such as aluminum or composite arrows that are commonly used today. Further, each fletch may be replaced as an individual unit so that damage to one feather member does not require replacement of all fletching at one time.

Attachment of the fletch to an arrow is quickly, simply, and conveniently accomplished according to the invented installation method. Removal of the fletch similarly quick, simple, and convenient. The fletch may be installed on an arrow with locating holes pre-drilled through the arrow body, or holes may be conveniently drilled in an arrow body using the jig supplied with the invented kit.

BRIEF DESCRIPTION OF THE SEVERAL VIEWS OF THE DRAWINGS

Figure 1:
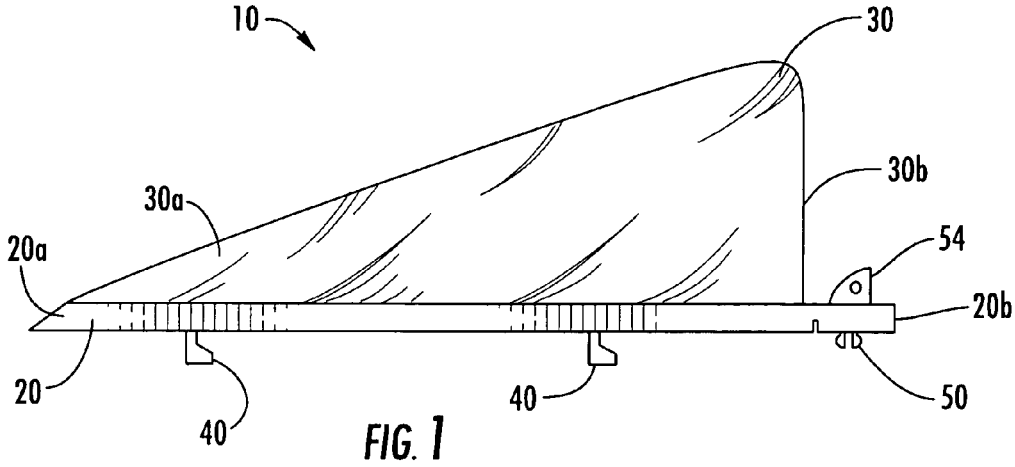
Figure 2:
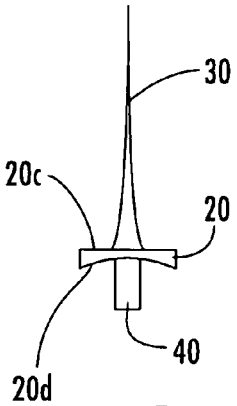
Figure 3:
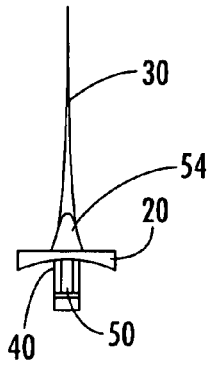
Figure 4:
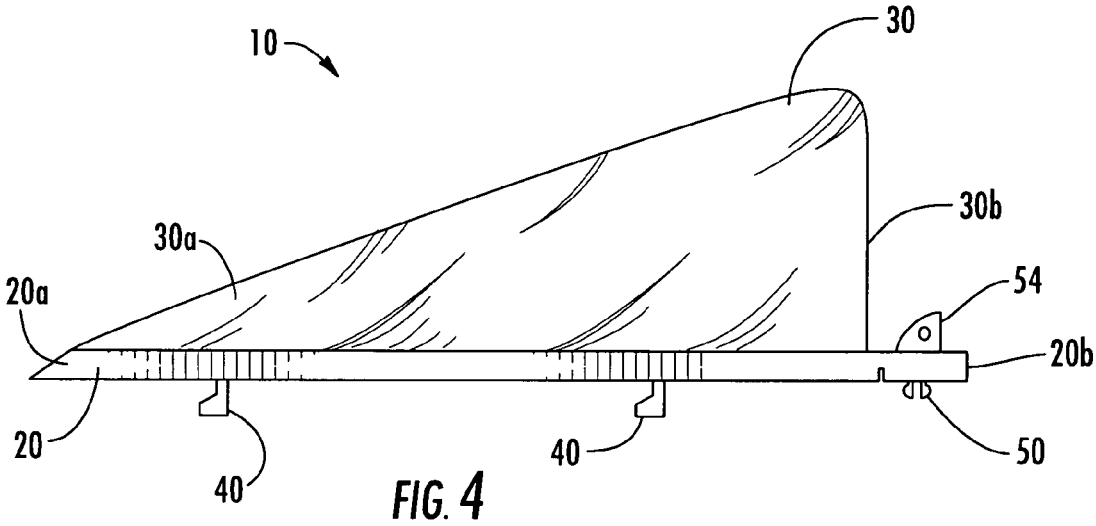
Figure 5:
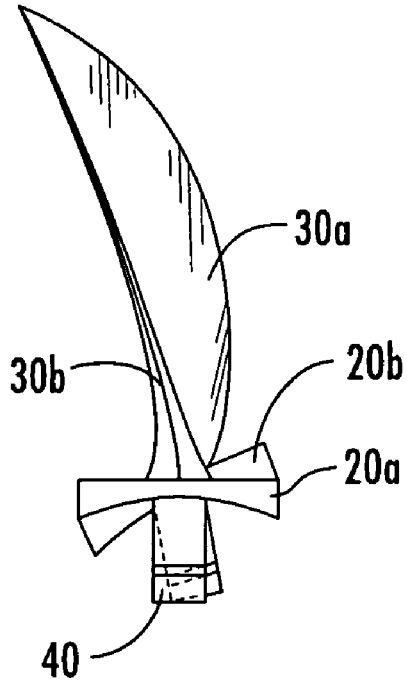
Figure 6:
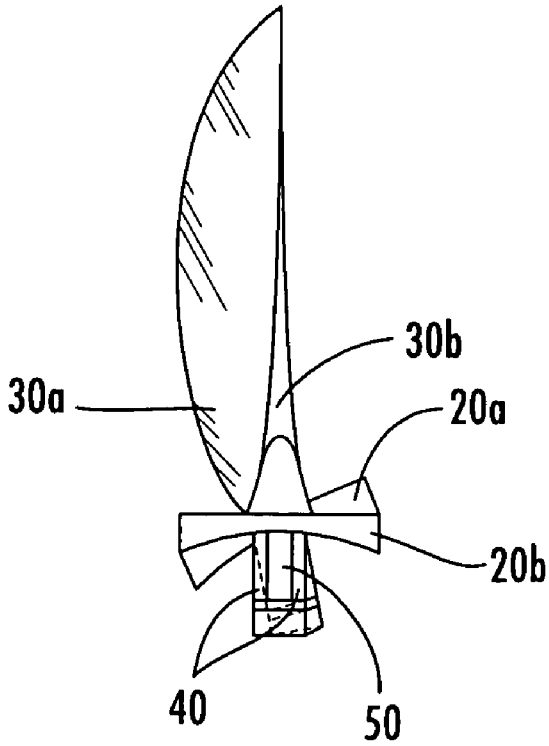
Figure 7:
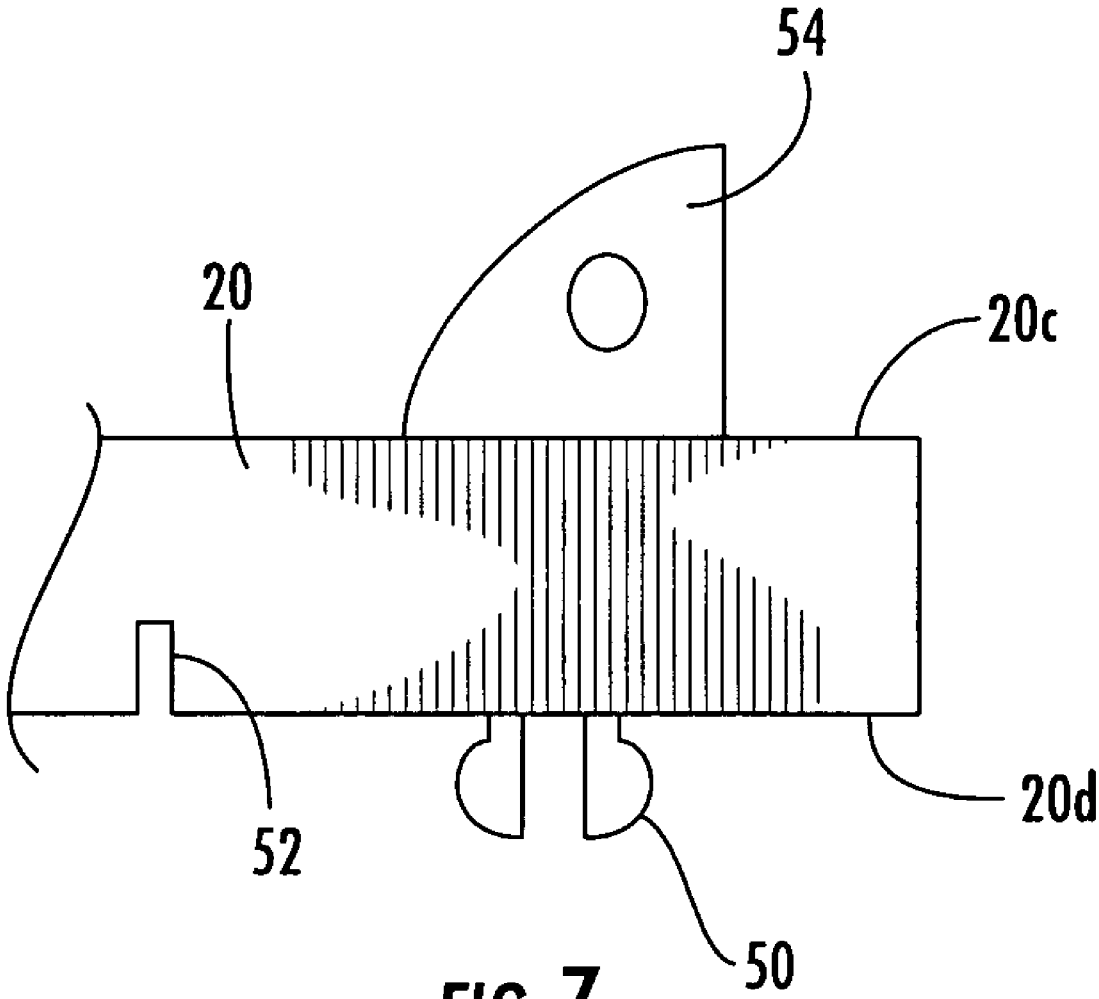
Figure 8:
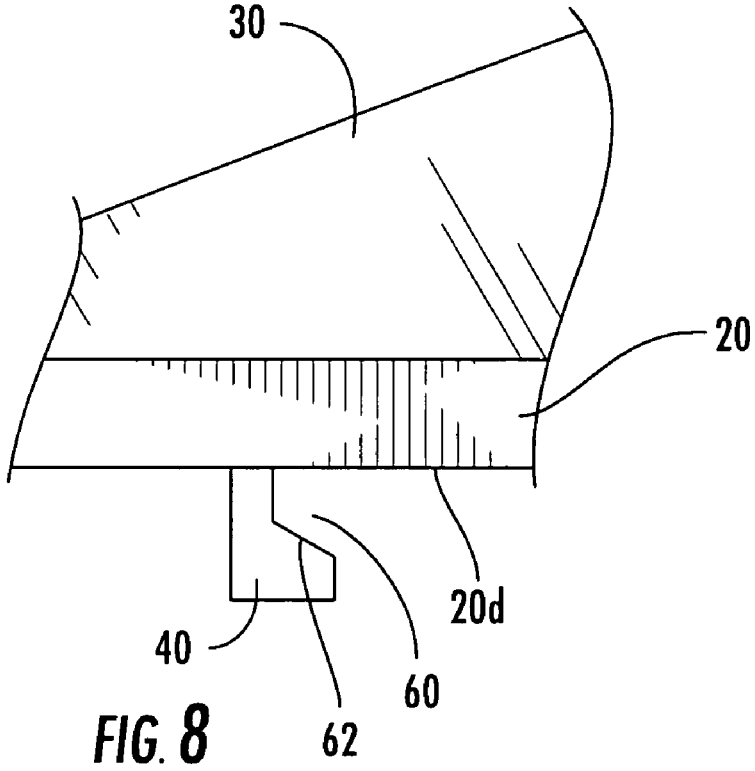
Figure 9:
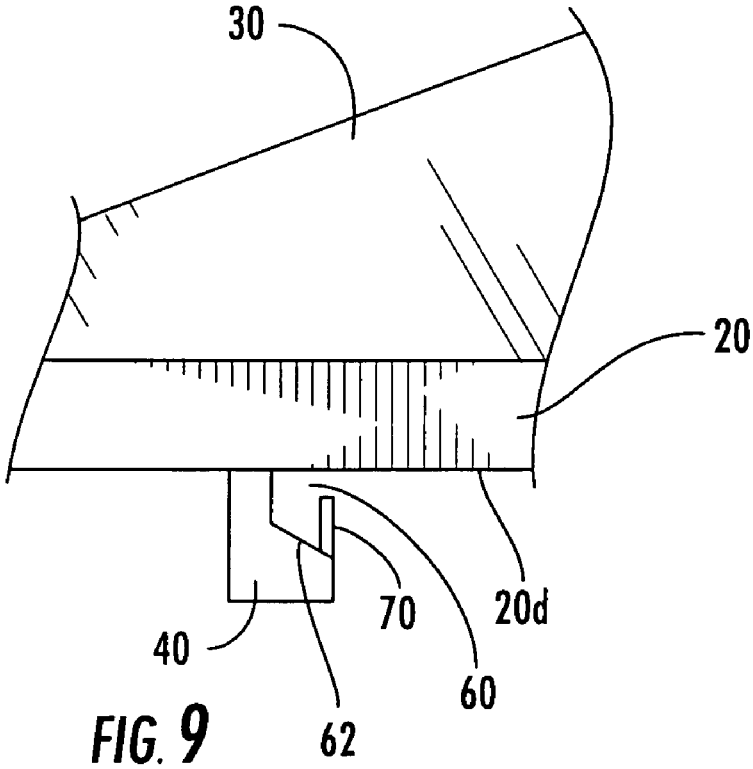
Figure 10:
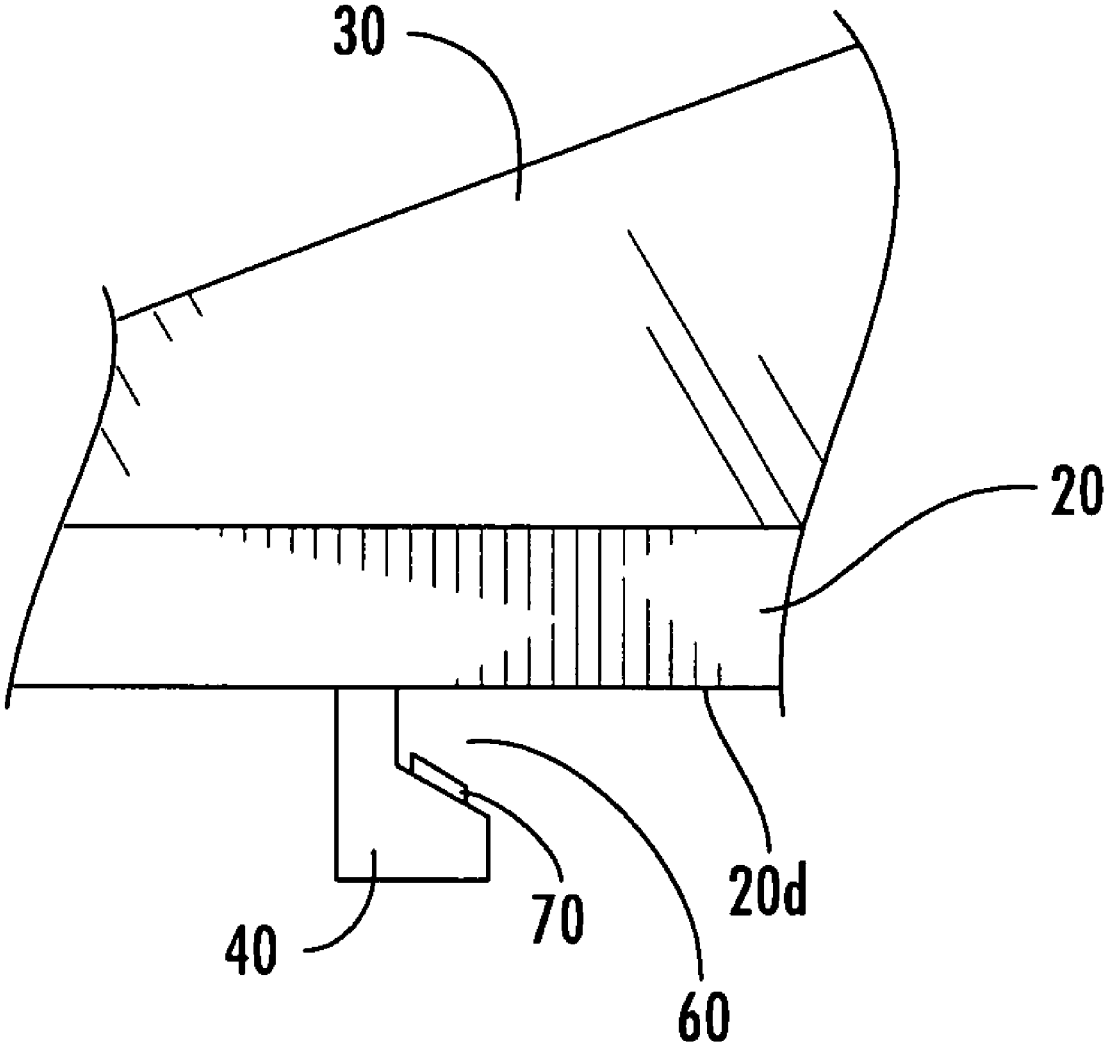
Figure 11:
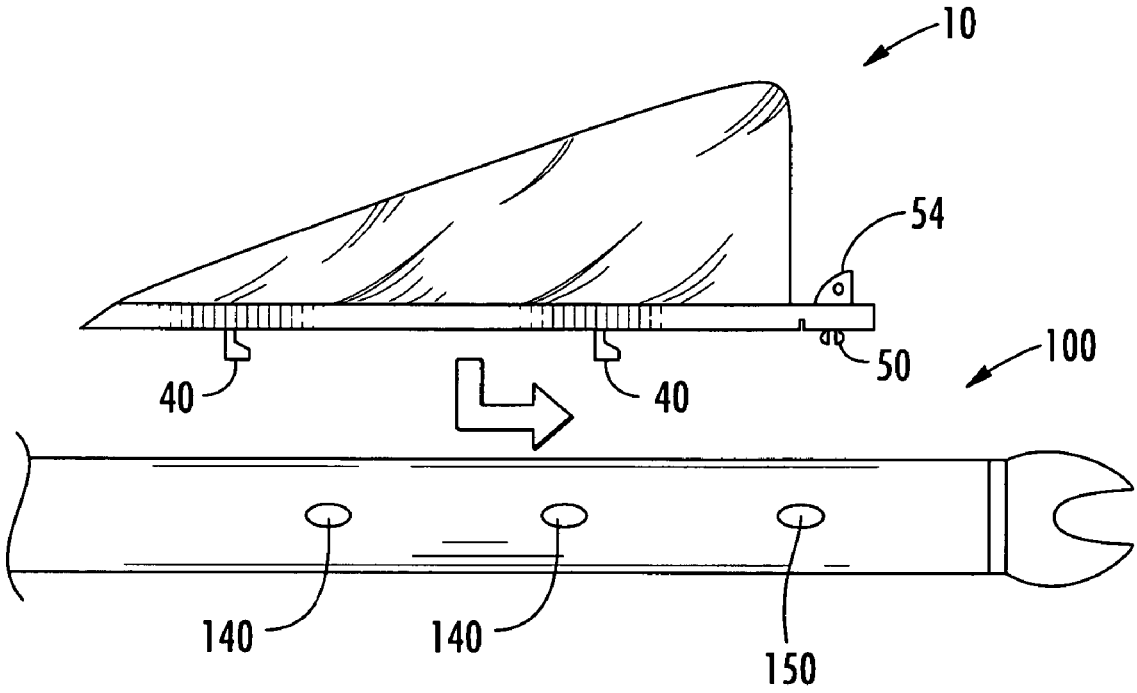
Figure 12:
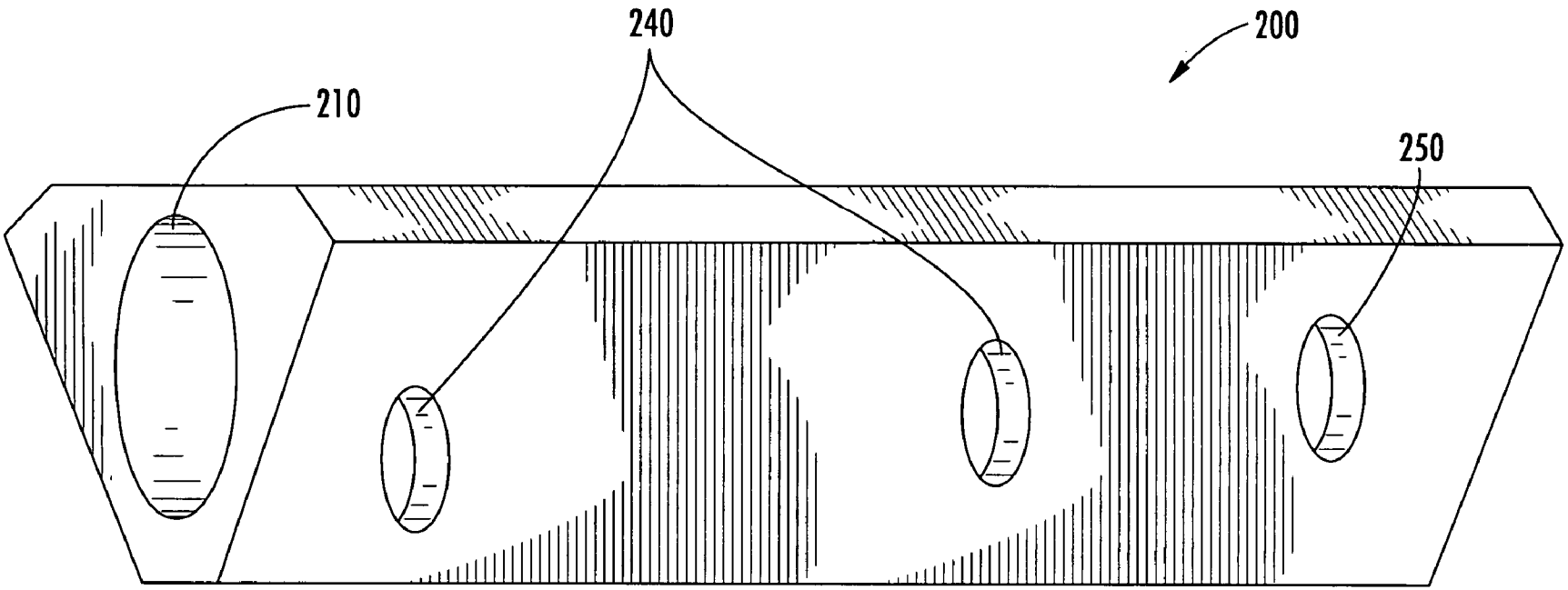

Having thus described the invention in general terms, reference will now be made to the accompanying drawings, which are not necessarily drawn to scale, and wherein:

FIG. 1 is a side view of a replaceable fletch in accordance with an embodiment of the invention;

FIG. 2 is a front view of the replaceable fletch of FIG. 1;

FIG. 3 is a rear view of the replaceable fletch of FIG. 1;

FIG. 4 is a side view of a replaceable fletch in accordance with the invention having different locating pin orientation than the embodiment of FIG. 1;

FIG. 5 is a front view of a replaceable fletch in accordance with an alternative embodiment of the invention;

FIG. 6 is a rear view of the replaceable fletch of FIG. 4;

FIG. 7 is a closeup view of a locking pin in accordance with an embodiment of the invention;

FIG. 8 is a closeup view of a locating pin in accordance with an embodiment of the invention;

FIGS. 9 and 10 are closeup views of a locating pin in accordance with an alternative embodiment of the invention;

FIG. 11 is an illustration of the installation of a replaceable fletch upon an arrow body, together comprising a system according to an embodiment of the invention; and FIG. 12 is a perspective view of a drill jig in accordance with another alternative embodiment of the invention.

DETAILED DESCRIPTION OF THE INVENTION

The present invention now will be described more fully hereinafter with reference to the accompanying drawings, in which some, but not all embodiments of the inventions are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring to FIGS. 1–3, one embodiment of the removable fletch is shown having an elongate mounting body 20 having a forward end 20*a* and rearward end 20*b*, and also having an upper 20*c* and a lower 20*d* surface. A feather member 30 extends from the upper surface of the mounting body 20. The feather member has a forward end 30*a* and a rearward end 30*b* which correspond with the respective forward 20*a* and rearward 20*b* ends of the mounting member 20. At least one locating pin 40 extends from the lower surface of the mounting body 20. Also, at least one locking pin 50 extends from the lower surface of the mounting body 20. A handle member 54 advantageously extends from the upper surface of the mounting member 20 opposite the locking pin 50.

The mounting body 20 is advantageously a slender strip of rigid or semi-flexible material. As shown in FIGS. 2 and 3, the lower 20*d* surface of the mounting body 20 is advantageously curved to correspond with the outer cylindrical diameter of an archery arrow. The mounting body 20 advantageously has a narrow profile such that the thickness of the mounting body does not interfere with the aerodynamics of the arrow but still provides structural support for the feather member 30 and locating pins 40. The mounting body is advantageously straight as illustrated in FIGS. 2 and 3. Alternatively, referring to FIGS. 5 and 6, the mounting member 20 may be twisted slightly into a helical orientation from its forward end 20*a* to its rearward end 20*b*. The helical embodiment of the mounting member 20 results in a curved feather member 30 which causes rotation of an arrow during flight.

Referring again to FIGS. 1–3, the feather member 30 is fixedly attached to or integrally molded with the mounting body 20. The feather member 30 is advantageously a flexible material, and may be a flexible polymeric film or any material known in the art of fletching.

Referring to FIGS. 8 and 9, at least one locating pin 40 extends from the mounting body 20 opposite the feather member 30. The locating pin 40 defines an engagement notch 60. The engagement notch 60 has a primary engagement surface 62 that is sloped or curved upward toward the lower surface 20*d* of the mounting body 20 so as to form an acute angle with the lower surface 20*d* of the mounting body. The engagement notch is oriented such that the engagement surface 62 faces in only one of the forward or rearward direction, i.e. toward the forward end 20*a* or the rearward end 20*b* of the mounting body 20. Additionally, when more than one locating pin 40 are used, the engagement surfaces 62 are commonly oriented. The locating pins 40 are advantageously cylindrical and extend in a direction perpendicular to the mounting body 20. However, the locating pins 40 could be of any geometric shape or configuration that allows for insertion of the locating pins within holes of an arrow body.

The primary engagement surface 62 of the locating pin stands in contrast to flexible insertion members, such as conical anchor stems, used for attachment of prior art fletches. The prior art members are typically symmetrical and do not define a primary engagement surface.

Referring to FIGS. 9 and 10, the locating pins may comprise a deflectable extension 70 positioned adjacent the engagement surface 62 and projecting generally towards the mounting body 20. The extension 70 provides for a varying space between the engagement surface 62 and mounting body 20 in order to account for different thicknesses of arrow bodies. For instance, the wall of a thin walled arrow may fit snugly between the extension 70 and the lower surface of the mounting body 20, whereas the thick wall of a thick walled arrow body may cause deflection of the extension 70 but still fits snugly between the deflected extension 70, the engagement surface, and the lower surface of the mounting body 20. Thus, the deflectable extension 70 aids in obtaining a snug fit with arrow walls of different thicknesses. Referring to FIG. 9, the deflectable extension 70 may be a thin deflectable lip extending toward the lower surface 20*d* from the engagement surface 62, where the lip is adjacent the edge of the engagement surface. Referring to FIG. 10, the deflectable extension 70 may be a thin vane running at least a portion of the length of the engagement surface 62, i.e. from a lower region to an upper region of the engagement surface 62.

Referring to FIG. 7, an exemplary locking pin 50 is shown extending from the lower surface 20*d* of the mounting body 20. The locking pin 50 may be any shape that prevents translational movement of the mounting body forward or backwards with respect to an arrow when the locking pin 50 is inserted within a corresponding hole in the arrow wall. The locking pin 50 advantageously has a snap fit feature, such as deflecting members which act to secure the locking pin in place once inserted through a hole in the arrow body. As shown in FIG. 6, the locking pin may comprise two lobed members that deflect inward towards one another when compressed within a hole and deflect outwards as the outer surface of the arrow body becomes flush with the second surface of the mounting body 20. A locking notch 52 is advantageously defined by the mounting body adjacent the locking pin 50. The locking notch 52 advantageously allows for a slight deflection of the mounting body 20 near the locking pin 50 during installation and removal of the fletch from the arrow.

A small handle feature 54 is advantageously positioned on the upper surface 20*c* of the mounting body 20 opposing the locking pin 50. The handle feature 54 is advantageous for enabling the removal of the locking pin 50 from the arrow body by pulling upwards on the handle 54. As shown in FIG. 3, the handle 54 advantageously has a flat rearward facing surface allowing for coating with or attachment to a reflective material. Such reflective material facing the rear of the mounting body assists in location and identification of arrows after being shot into targets, underbrush, etc.

Referring to FIG. 11, in accordance with a second embodiment of the invention, a replaceable fletch system is provided comprising the removable fletch as described in the first embodiment in conjunction with a pre-drilled hollow shafted archery arrow 100 having locating holes 140 defined through the wall of the arrow that correspond to the locating pins 40 of the fletch, and a locking hole 150 defined through the wall of the arrow that corresponds to the locking pin 50 of the fletch. Note that the distance between the rearward locating pin hole 140 and the locking pin hole 150 is slightly greater than the distance between the rearward locating pin 40 and the locking pin 50 such that the locking pin 50 will only be insertable within the locking pin hole 150 once the locating pins 40 are inserted into locating pin holes 140 and the fletch has been translated backwards with respect to the arrow body 100.

Still referring to FIG. 11, in accordance with a third embodiment of the invention, a method for installing the invented fletch is illustrated. As shown, an arrow body 100 has been pre-drilled with holes corresponding to the locating pins 140 and the locking pin 150. To install the fletch 10 within the arrow body 100, the locating pins 40 are inserted into the corresponding locating pin holes 140. The fletch is then pulled rearward with respect to the arrow body 100. As the fletch is pulled rearward, the angled engagement surfaces of the locating pins 40 draw the fletch towards the center of the arrow body until the lower 20*d* surface of the mounting body 20 is in firm frictional contact with the outer surface of the arrow body and the engagement surface of the locating pins 40 is in firm frictional contact with the inner surface of the arrow body 100. Once the fletch is pulled rearward with respect to the arrow body 100, the locking pin 50 is located over locking pin hole 150 and may be snap fit within the hole 150. To remove the fletch, locking pin 50 would be pulled upward and away from the arrow body 100 such that the fletch 10 could be moved forward with respect to the arrow body 100 and finally moved upward and away from the arrow body.

Referring to FIG. 1, the engagement surfaces 62 of the locating pins 40 preferably face rearward such that the fletch is locked in place by translating the inserted fletch rearward before locking the locking pin 50 in place. This is an advantageous arrangement because the initial thrust imposed on the arrow body upon being shot will urge the arrow body against the locating pins thereby tightening the friction fit of the arrow and fletch. Alternatively, referring to FIG. 4, the engagement surfaces 62 of the locating pins 40 could face forward such that the fletch is locked in place by translating the inserted fletch forward before locking the locking pin 50 in place.

According to a fourth embodiment of the invention, a fletch replacement kit is provided, comprising at least one fletch as described above and a drill jig. Referring to FIG. 12, the contemplated drill jig 200 is an elongate member having a central bore 210 defined through the jig, at least one locating pin guide hole 240 defined through a portion of the jig perpendicular to the central bore, and at least one locking pin guide hole 250 defined through a portion of the jig perpendicular to the central bore. Holes may be easily drilled within an arrow body corresponding to the locating and locking pins of the fletch by inserting the arrow body through the central bore 210 and drilling holes through the arrow wall as directed by the locating and locking pin guide holes 240,250. The guide holes of the jig may be positioned such that their centers define a line parallel to the center line of the central bore 210. Alternatively, the guide holes may be offset with respect to the central bore 210 as shown in FIG. 12. This offset arrangement provides holes within an arrow body that correspond to mounting bodies having helical twists as shown in FIGS. 5 and 6. With use of the jig 200, the invented fletch may be used with commercially available hollow-shafted archery arrows that have not been pre-drilled to accept the invented fletches.

Many modifications and other embodiments of the invention set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A removable fletch for a removable fletch system, the system including a hollow-shafted arrow having a wall with longitudinally spaced holes disposed therein, the removable fletch comprising:

an elongate mounting body;

a feather member extending from the mounting body;

at least one locating pin extending from the mounting body opposite the feather member, said locating pin defining an engagement notch, wherein the at least one locating pin is configured relative to the corresponding hole(s) in the wall of the arrow to permit the mounting body to be translated along the arrow after insertion of the at least one locating pin into the corresponding hole(s), and, a locking pin extending from the mounting body opposite the feather member, the locking pin having a configuration different from that of the at least one locating pin, the locking pin being configured to engage another one of the holes in the wall of the arrow to prevent translational movement of the mounting body with respect to the arrow.

2. The removable fletch of claim 1, wherein the elongate mounting body has a forward end and a rearward end and an upper and a lower surface; and wherein the engagement notch has a primary engagement surface that is sloped or curved upward toward the lower surface of the mounting body and oriented such that the engagement surface faces in the direction of the forward or rearward end of the mounting body.

3. The removable fletch of claim 2, wherein the fletch has two or more locating pins with engagement surfaces that are oriented in the same direction.

4. The removable fletch of claim 2, wherein the locating pins are cylindrical except for the portion of the pins that define the engagement surface.

5. The removable fletch of claim 2, wherein the lower surface is curved.

6. The removable fletch of claim 1, further comprising a handle member extending from the mounting body adjacent to but opposing the locking pin.

7. The removable fletch of claim 6, wherein the elongate mounting body has a forward end and a rearward end, and wherein the handle member comprises a reflective surface facing the rearward end of the mounting body.

8. The removable fletch of claim 1, wherein the locking pin comprises a deformable protrusion suitable for being snap-fit within a hole.

9. A removable fletch system, comprising at least one fletch having an elongate mounting body;

a feather member extending from the mounting body;

at least one locating pin extending from the mounting body opposite the feather member, said locating pin defining an engagement notch; and a locking pin extending from the mounting body opposite the feather member; and a hollow-shafted arrow having holes disposed therein, wherein the holes correspond to the location of the locating pin and the locking pin of the at least one fletch;

wherein the at least one locating pin and the holes are configured to permit the mounting body to be translated along the arrow after insertion of the at least one locating pin into the corresponding hole(s), and wherein the locking pin has a configuration different from that of the at least one locating pin, the locking pin being configured to engage one of the holes in the arrow and to prevent translational movement of the mounting body with respect to the arrow.

10. The removable fletch system of claim 9, wherein the elongate mounting body has a forward end and a rearward end and an upper and a lower surface; and wherein the engagement notch has a primary engagement surface that is sloped or curved upward toward the lower surface of the mounting body and oriented such that the engagement surface faces in the direction of the forward or rearward end of the mounting body.

11. The removable fletch system of claim 10, wherein the fletch has two or more locating pins with engagement surfaces that are oriented in the same direction.

12. The removable fletch system of claim 10, wherein the locating pins are cylindrical except for the portion of the pins that define the engagement surface.

13. The removable fletch system of claim 10, wherein the lower surface is curved and corresponds to the outer surface of the hollow-shafted arrow.

14. The removable fletch system of claim 9, further comprising a handle member extending from the mounting body adjacent to but opposing the locking pin.

15. The removable fletch system of claim 14, wherein the elongate mounting body has a forward end and a rearward end, and wherein the handle member comprises a reflective surface facing the rearward end of the mounting body.

16. A method of replacing the fletch of an arrow, the method comprising the steps of:

providing at least one fletch having an elongate mounting body;

a feather member extending from the mounting body;

at least one locating pin extending from the mounting body opposite the feather member, said locating pin defining an engagement notch; and a locking pin extending from the mounting body opposite the feather member; providing a hollow-shafted arrow having holes disposed therein, wherein at least one locating hole corresponds to the location of the locating pin and a locking hole corresponds to the locking pin of the at least one fletch;

inserting the at least one locating pin of the fletch into the corresponding locating hole of the arrow;

translating the fletch in the lengthwise direction of the arrow such that the engagement notch of the locating pin contacts the inner surface of the arrow; and inserting that locking pin of the fletch into the corresponding locking hole of the arrow.

17. The method of replacing the fletch of an arrow according to claim 16, wherein the elongate mounting body has a forward end and a rearward end and an upper and a lower surface; and wherein the engagement notch has a primary engagement surface that is sloped or curved upward toward the lower surface of the mounting body and oriented such that the engagement surface faces in the direction of the forward or rearward end of the mounting body.

18. The method of replacing the fletch of an arrow according to claim 17, wherein the fletch has two or more locating pins with engagement surfaces that are oriented in the same direction.

19. The method of replacing the fletch of an arrow according to claim 17, wherein the locating pins are cylindrical except for the portion of the pins that define the engagement surface.

20. A fletch replacement kit, comprising at least one fletch having an elongate mounting body;

a feather member extending from the mounting body;

at least one locating pin extending from the mounting body opposite the feather member, said locating pin defining an engagement notch; and a locking pin extending from the mounting body opposite the feather member; and a drill jig having a central bore defined through the jig;

at least one locating pin guide hole defined through a portion of the jig perpendicular to the central bore; and at least one locking pin guide hole defined through a portion of the jig perpendicular to the central bore.

* * * * *